United States Patent [19]

Obata et al.

[11] Patent Number: 4,673,470

[45] Date of Patent: Jun. 16, 1987

[54] TIN, LEAD, OR TIN-LEAD ALLOY PLATING BATH

[75] Inventors: Keigo Obata, 8-1 Koriki-cho, Himeji-shi, Hyogo-ken; Nobuyasu Dohi, 1-4 Tsukimiyamahonmachi 1-chome, Suma-ku, Kobe-shi, Hyogo-ken Yoshiaki Okuhama, Kobe; Seishi Masaki, Kobe; Yukiyoshi Okada, Kobe; Masakazu Yoshimoto, Kobe, all of Japan

[73] Assignees: Keigo Obata; Nobuyasu Dohi; Daiwa Fine Chemicals Co., Ltd.; Ishihara Chemical Co., Ltd., all of Hyogo, Japan

[21] Appl. No.: 831,762

[22] Filed: Feb. 21, 1986

[30] Foreign Application Priority Data

Feb. 22, 1985 [JP] Japan ..... 60-32746

[51] Int. Cl.[4] ..... C25D 3/32; C25D 3/36; C25D 3/56; C25D 3/60

[52] U.S. Cl. ..... 204/44.4; 204/53; 204/54.1

[58] Field of Search ..... 204/44.4, 53, 54 R, 204/54 L

[56] References Cited

U.S. PATENT DOCUMENTS 3,905,878 9/1975 Dohi et al. ..... 204/44.4
4,132,610 1/1979 Dohi et al. ..... 204/44.4
4,459,185 7/1984 Obata et al. ..... 204/44.4
4,555,314 11/1985 Obata et al. ..... 204/44.4

FOREIGN PATENT DOCUMENTS 256456 4/1970 U.S.S.R. ..... 204/54 R
574485 10/1977 U.S.S.R. ..... 204/54 R

*Primary Examiner*—G. L. Kaplan
*Attorney, Agent, or Firm*—Armstrong, Nikaido, Marmelstein & Kubovcik

[57] ABSTRACT

A tin, lead, or tin-lead alloy plating bath comprising, as essential ingredients, an alkali metal salt, and a soluble divalent tin compound or/and a lead compound, all of an aliphatic or aromatic sulfocarboxylic acid of the general formula

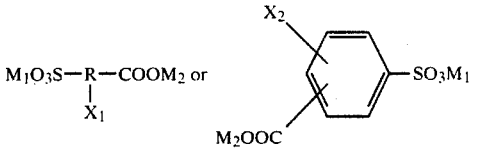

wherein R is a $C_{1-4}$ hydrocarbon radical, $M_1$ is a hydrogen atom or alkali metal atom, $M_2$ is an alkali metal atom, and $X_1$ and $X_2$ are each a hydrogen atom, OH, COON, or $SO_3N$ (where N represents a hydrogen atom or alkali metal atom).

10 Claims, No Drawings

TIN, LEAD, OR TIN-LEAD ALLOY PLATING BATH

BACKGROUND OF THE INVENTION

This invention relates to a tin, lead, or tin-lead alloy plating bath. It particularly relates to a tin, lead, or tin-lead alloy plating bath which can be used in a substantially neutral pH range (pH 2.0–9.0), characterized by the addition of an alkali metal salt of an aliphatic or aromatic sulfocarboxylic acid.

Tin plating and tin-lead alloy plating have in recent years been widely used in light electric and electronic industries to form coatings for enhanced solderability or as etching resists on their component parts. The plating techniques have, however, left much room for improvement. The electronic parts that integrally incorporate elements of insulating materials such as ceramics, lead glass, or plastics and electroplated members, call for plating capable of ensuring excellent solder-ability and adhesion without any such drawback as corrosion, deformation, or change in properties of the products.

For the plating of the electronic parts of the character it has been routine to use a bath of borofluoride, sulfuric acid, organic sulfonic acid or the like. A typical example of the organic sulfonic acid bath is disclosed in Japanese Patent Application Publication No. 16176/1974. The specification describes an electroplating bath containing a complex salt of sulfonic acid by subjecting an excess amount of an aliphatic or aromatic sulfonic acid to the action of a compound of the metal to be electrodeposited. Such a plating bath, containing a large proportion of free sulfonic acid, is strongly acidic with pH 1.0 or below. The borofluoride and sulfuric acid baths too are strongly acidic. A disadvantage common to these baths of high acidity is, for example, the attack on lead glass in the course of tin-lead alloy plating of integrated-circuit parts that use the particular glass.

To eliminate this disadvantage, it was attempted to adjust the pH of the plating bath so as to be close to neutrality. However, the tin ions, normally stable in an acidic bath, form a white precipitate of stannous hydroxide at pH values around neutrality, rendering tin or tin-lead alloy plating infeasible. If the formation of such a white stannate precipitate is to be avoided, the addition of a complexing agent, e.g., gluconic, citric, tartaric, or malonic acid, will be necessary. Such a complexing agent tends to decompose on electrolysis or reduce the current efficiency, and makes it difficult, especially in tin-lead alloy plating, to control the electrodeposit composition (Sn/Pb).

It has now been found, after our search for ways of overcoming the drawbacks of the strongly acidic plating baths, that the addition of a certain aliphatic or aromatic sulfocarboxylic acid as a complexing agent stabilizes a tin, lead, or tin-lead alloy plating bath without the formation of a stannous hydroxide precipitate, even in the pH range around neutrality.

SUMMARY OF THE INVENTION

Therefore, it is an object of the present invention to provide a tin, lead, or tin-lead alloy plating bath which remains stable in the pH range around neutrality (pH 2.0–9.0) and is usable at a high current efficiency over a broad current density range.

Another object of the invention is to provide a tin, lead, or tin-lead alloy plating bath capable of plating electronic parts which are integral combinations of insulating elements of lead glass, ceramics or the like and electroplated members, without chemically attacking, deforming, changing the properties or otherwise adversely affecting the parts.

These objects are perfectly realized in accordance with the invention. Briefly, the invention resides in a tin, lead, or tin-lead alloy plating bath consisting essentially of an alkali metal salt, and a soluble divalent tin salt or/and a lead salt, all of an aliphatic or aromatic sulfocarboxylic acid of the general formula

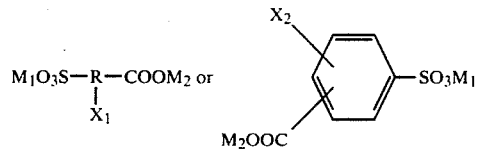

wherein R is a $C_{1-4}$ hydrocarbon radical, $M_1$ is a hydrogen atom or alkali metal atom, $M_2$ is an alkali metal atom, and $X_1$ and $X_2$ are each a hydrogen atom, OH, COON, or $SO_3N$ (where N represents a hydrogen atom or alkali metal atom).

DETAILED DESCRIPTION

An alkali metal salt of an aliphatic sulfocarboxylic acid which may be used in preparing a plating bath according to the invention is any of the salts of the acids having the above formula in which R represents a saturated or unsaturated linear or branched hydrocarbon radical having 1 to 8 carbon atoms. Examples of these acids are 2-sulfomaleic and sulfofumaric acids. A preferably employable alkali metal salt of such acids is mono-, di-, or trisodium salt, or mono-, di-, or tripotassium salt.

An alkali metal salt of an aromatic sulfocarboxylic acid likewise employable is any of the salts of the acids represented by the formulas:

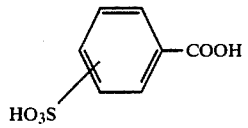

sulfobenzoic acid

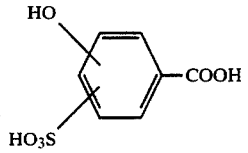

hydroxysulfobenzoic acid

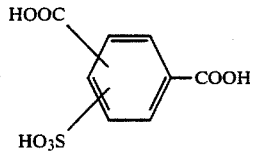

sulfophthalic acid

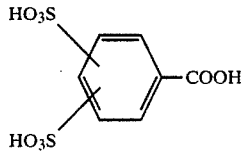

disulfobenzoic acid

Preferred as an alkali metal salt of these aromatic sulfocarboxylic acids is mono-, di-, or trisodium salt, or mono-, di-, or tripotassium salt.

The above-mentioned alkali metal salts of sulfocarboxylic acids may be used singly or as a mixture of two or more.

For use in the present invention the alkali metal salt of an aliphatic or aromatic sulfocarboxylic acid is either directly dissolved in a plating bath or added in the form of a solution prepared beforehand by neutralizing the sulfocarboxylic acid with an alkali metal compound such as an alkali hydroxide. For example, an aqueous solution of a sulfocarboxylate is prepared by neutralizing the acid with an aqueous solution of a sufficient amount of an alkali hydroxide, such as sodium or potassium hydroxide, to maintain the plating bath in the pH range of 2.0–9.0, preferably in the range of 3.0–8.5, and then this aqueous sulfocarboxylate solution is added to the plating bath. The degree of neutralization is adjusted according to the desired pH value of the plating bath. The alkali metal salt of a sulfocarboxylic acid may also be formed by directly adding the acid to a plating bath and then neutralizing it by the further addition of a predetermined amount of an alkali hydroxide or other similar alkali compound. In this case, too, the amount of the alkali compound is adjusted so as to keep the pH of the bath in the range of 2.0–9.0, preferably in the range of 3.0–8.5.

As a further alternative, the addition of the alkali metal salt of the sulfocarboxylic acid may be followed by separate introduction of the sulfocarboxylic acid and an alkali compound to adjust the pH as desired.

The alkali metal salt of the sulfocarboxylic acid is allowed to be present in the plating bath of the invention at a concentration of 0.01–10 moles per liter of the plating solution.

According to this invention, the pH of the plating bath can be adjusted within a range generally around neutrality, that is, in the range of 2.0–9.0, preferably 3.0–8.5, by allowing the bath to contain an alkali metal salt of a sulfocarboxylic acid as mentioned earlier. The alkali metal salt, at the same time, acts as a complexing agent which complexes the ions of the metal to be deposited, such as tin, lead, or a tin-lead alloy, to be described later, and thereby permits stable dissolution of the metal in the bath.

Another ingredient or ingredients to be contained in the plating bath of the invention are soluble compounds of the particular metal to be deposited. Various soluble divalent tin and lead compounds, as grouped below, may be employed. In the case of tin-lead alloy plating, as is obvious to those skilled in the art, a mixture of such a divalent tin compound and a lead compound is used.

The first group of the soluble compounds that may be cited for example comprises divalent tin salts and lead salts of aliphatic or aromatic sulfocarboxylic acid having the general formula

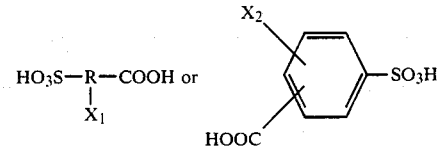

wherein R is a $C_{1-4}$ hydrocarbon radical, $X_1$ and $X_2$ are each a hydrogen atom, OH, COOH, or $SO_3H$. The sulfocarboxylic acids that give these salts are the same as those already described as acids forming alkali metal salts. Therefore, the above-mentioned acids may be employed here. Their salts are prepared in the usual manner.

The second group of soluble compounds is made up of divalent tin salts and lead salts of alkane- or alkanolsulfonic acids having the general formula $$R_1—SO_3H \text{ or } HO—R_2—SO_3H$$

wherein $R_1$ is a $C_{1-12}$ alkyl radical and $R_2$ is a $C_{1-12}$ alkylene radical, OH being located in any desired position of the alkylene radical.

Examples of alkanesulfonic acids that give these salts are methane-, ethane-, propane-, 2-propane-, butane-, 2-butane-, pentane-, hexane-, decane-, and dodecanesulfonic acids. These alkanesulfonic acids may be used singly or as a mixture of two or more.

Examples of alkanolsulfonic acids are isethionic acid and 2-hydroxyethane-1-, 2-hydroxypropane-1-, 1-hydroxypropane-2-, 3-hydroxypropane-1-, 2-hydroxybutane-1-, 4-hydroxybutane-1-, 2-hydroxypentane-1-, 2-hydroxyhexane-1-, 2-hydroxydecane-1-, and 2-hydroxydodecane-1-sulfonic acids. These hydroxyl-containing alkanesulfonic acids may be employed alone or in a combination of two or more.

These tin and lead salts are prepared by the usual method.

The third group of soluble compounds which may be employed is of divalent tin and lead salts of organic carboxylic acids. Desirable acids are acetic, propionic, butyric, oxalic, and malonic acids. The tin and lead salts of these acids are prepared conventionally.

The fourth group of the soluble compounds is constituted by stannous salts and lead salts of inorganic acids, such as of carbonic and sulfuric acids. Stannous oxide and lead oxide may be used as well.

The soluble compound of tin or lead is allowed to be present in the plating bath, at a concentration in terms of the metallic element of 0.5–200 g/l. Likewise, in tin-lead alloy plating, the tin and lead compounds may be present at a total concentration of 0.5–200 g/l. In accordance with the invention, a plated coating having substantially the same Sn/Pb ratio as that of the plating bath can be obtained under a broad range of current densities including low current density conditions.

The plating bath of the invention may contain a surface active agent, especially a nonionic one, which improves the dispersibility of the bath and allows the bath to form an adherent, smooth plated coating. Nonionic surface active agents have proved effective in enhancing the throwing power in electroplating at a low current density.

The nonionic surface active agents that may be effectively utilized in the plating bath of the invention have the general formula (I)

$$RA—(CH_2—\overset{R'}{\overset{|}{C}}H—O)_m—(CH_2—\overset{R''}{\overset{|}{C}}H—O)_nH \quad (I)$$

wherein RA is a residue of a $C_{8-20}$ alkanol, $C_{1-25}$ alkylphenol, $C_{1-25}$ alkyl-$\beta$-naphthol, $C_{3-22}$ aliphatic amine, $C_{3-22}$ fatty acid amide, $C_{1-25}$ alkoxylated phosphoric acid, $C_{8-22}$ higher-fatty-acid-esterified sorbitan ester, or of a styrenated phenol (in which the hydrogen of the phenol nucleus may be substituted with a $C_{1-4}$ alkyl or phenyl methyl radical) with the proviso that when R′ is a hydrogen atom R″ is a methyl radical or vice versa, and m and n are each an integer of 1–30.

Such a useful nonionic surface active agent of the formula (I) for the plating bath of the invention may be one well known in the art. It may be prepared in the usual manner, for example, by addition condensation of a $C_{8-22}$ higher alcohol, alkylphenol, alkyl-$\beta$-naphthol, $C_{3-22}$ aliphatic amine residue, $C_{3-22}$ fatty acid amide, alkoxylated phosphoric acid, $C_{8-22}$ higher-fatty-acid-esterified sorbitan or styrenated phenol with ethylene oxide (or propylene oxide) and further with propylene oxide (or ethylene oxide).

Among the higher alcohols that can be addition condensed with ethylene oxide or propylene oxide are octanol, decanol, lauryl alcohol, tetradecanol, hexadecanol, stearyl alcohol, eicosanol, cetyl alcohol, oleyl alcohol, and docosanol. Useful alkylphenols are mono-, di-, or trialkylsubstituted phenols, e.g., p-butylphenol, p-isooctylphenol, p-nonylphenol, p-hexylphenol, 2,4-dibutylphenol, 2,4,6-tributylphenol, p-dodecylphenol, p-laurylphenol, and p-stearylphenol. Alkyl radicals for alkyl-$\beta$-naphthols include methyl, ethyl, propyl, butyl, hexyl, octyl, decyl, dodecyl, and octadecyl. They may assume any desired position in the naphthalene nucleus.

Examples of aliphatic amines are propyl, butyl, hexyl, octyl, decyl, lauryl, and stearylamines.

Examples of fatty acid amides are the amides of propionic, butyric, caprylic, capric, lauric, myristic, palmitic, stearic, and behemic acids. Alkoxylated phosphoric acids are represented by the formula

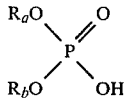

wherein $R_a$ and $R_b$ are $C_{1-25}$ alkyl radicals and either of them may be a hydrogen atom. They are obtained by esterifying one or two of the hydroxyl groups of phosphoric acid with an alcohol of a suitable chain length ($C_{1-25}$). Usable styrenated phenol is a mono-, di-, or tristyrenated phenol having the formula

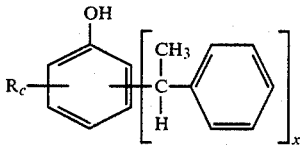

wherein $R_c$ is a hydrogen atom, $C_{1-4}$ alkyl radical, or phenyl radical, and x has a number of 1–3. The hydrogen in the phenol nucleus may be substituted with a $C_{1-4}$ alkyl or phenyl radical. A suitable example is a mono-, di-, or tristyrenated phenol, mono- or distyrenated cresol, or mono- or distyrenated phenylphenol. It may be a mixture of these phenols. Typical sorbitans esterified with higher fatty acids are mono-, di-, or tri-esterified 1,4-, 1,5-, and 3,6-sorbitans, e.g., sorbitan monolaurate, sorbitan monopalmitate, sorbitan monostearate, sorbitan oleate, sorbitan dilaurate, sorbitan dipalmitate, sorbitan distearate, sorbitan dioleate, and sorbitan mixed fatty acid esters.

The afore-mentioned nonionic surface active agents may be used singly or in combination.

The concentration of the nonionic surface active agent to be employed is usually in the range of 0.01–50 g/l, preferably in the range of 0.03–20 g/l.

To improve the smoothness of the plate surface, the plating bath of the invention may contain one of certain smoothening or leveling additives. Such an additive is used together with the nonionic surface active agent to achieve a synergetically favorable effect. The leveling additives that have proved particularly effective include those having the formulas (A) and (B).

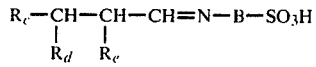

(A)

wherein $R_c$ is a hydrogen atom, $C_{1-4}$ alkyl radical, or phenyl radical, $R_d$ is a hydrogen atom or hydroxyl group, B is a $C_{1-4}$ alkylene, phenylene, or benzyl radical, and $R_e$ is a hydrogen atom or $C_{1-4}$ alkyl radical.

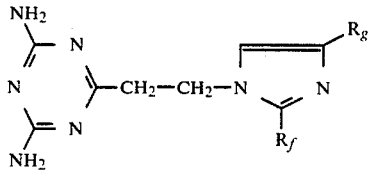

(B)

wherein $R_f$ and $R_g$ are each $C_{1-18}$ alkyl radical.

Of these leveling additives, particularly desirable are N-(3-hydroxybutylidene)-p-sulfanylic acid, n-butylidenesulfanilic acid, N-cinnamoylidenesulfanilic acid, 2,4-diamino-6-[2'-methylimidazolyl(1')]ethyl-1,3,5-triazine, 2,4-diamino-6-[2'-ethyl-4-methylimidazolyl(1')]ethyl-1,3,5-triazine, 2,4-diamino-6-[2'-undecylimidazolyl(1')]ethyl-1,3,5-triazine and the like.

The concentration of such a leveling additive ranges from 0.01 to 30 g/l, preferably from 0.03 to 5 g/l.

According to the preferred embodiment of the tin-lead alloy plating bath of the present invention, the plating bath may contains a certain guanamine compound capable of giving a deposit of a constant Sn/Pb ratio under high as well as low current density conditions.

Guanamine compounds which may be employed in the invention have the general formula

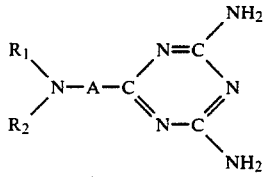

wherein $R_1$ and $R_2$, which may be the same or different, represent each a hydrogen atom, $C_{1-18}$ straight- or branched-chain alkyl radical, $C_{1-18}$ straight- or branched-chain alkoxy-lower alkyl radical, or a $C_{3-7}$ cycloalkyl radical, or $R_1$ and $R_2$ may combine to form a carbon cycle or hetero cycle, and A represents a lower alkylene radical.

Desirable guanamine compounds for the purposes of the invention include those of the above-mentioned general formula in which either $R_1$ or $R_2$ represents a hydrogen atom and the other represents a $C_{5-14}$ alkyl (e.g., pentyl, hexyl, heptyl, octyl, nonyl, decyl, or dodecyl), $C_{5-14}$ alkoxy-ethyl or alkoxy-propyl (e.g., pentyloxy-, hexyloxy-, peptyloxy-, octyloxy-, 2-ethylhexyloxy-, or decyloxy-ethyl or -propyl), or cyclohexyl radical, and, those in which $R_1$ and $R_2$ combine to form a piperidine, morpholine, or piperazine cycle. A desirable lower alkylene radical is ethylene or propylene radical.

Examples of guanamine compounds are β-N-dodecylamino-propioguanamine, β-N-hexylamino-propioguanamine, piperidine-propioguanamine, cyclohexylamino-propioguanamine, morpholine-propioguanamine, β-N-(2-ethylhexyl-oxypropylamino)-propioguanamine and β-N-(lauryloxy-propylamino)-propioguanamine.

A guanamine compound in accordance with the invention is added in an amount of 0.01 to 30 g, preferably 0.1 to 10 g, per liter of the plating solution.

The plating bath of the invention may contain a buffering agent to prevent changes in its hydrogen-ion concentration. The pH buffering agent is, for example, sodium or potassium acetate; sodium, potassium, or ammonium borate; sodium or potassium formate, or sodium or potassium tartarate. An anti-passivating agent may also be present.

Such an assistant or assistants may be contained in an amount of 1–200 g/l, preferably in an amount of 5–100 g/l.

The concentrations of the individual ingredients of the plating bath according to this invention may be optionally chosen depending on whether the plating is performed by the barrel, rack, high-speed continuous, or through-hole plating technique.

The plating bath of the invention is capable of producing uniform, dense plated coatings at a wide range of current densities.

The advantages of the invention are as follows:

(1) Tin-lead alloy plating with the pH around neutrality requires the addition of a complexing agent such as gluconic, citric, tartaric, or malonic acid. Without the additive, the plating would be impossible because tin ions normally stable in an acidic bath would form a white precipitate of stannous hydroxide. The complexing agent, however, tends to decompose partly during electrolysis, reduce the current efficiency, and make the electrodeposit composition (Sn/Pb) difficult to control. The sulfocarboxylate bath according to the invention, by contrast, does not require such a complexing agent as gluconic acid, because, over the pH range of 2.0–9.0, it causes no tin precipitation.

(2) Regardless of changes in the current density or in the pH, the Pb (%) in the electroplated coating remains substantially in agreement with that in the bath. The bath is therefore easy to control.

(3) The current efficiency to be achieved is high enough to broaden the usable current density range and make the invention applicable to barrel, rack, and high-speed plating operations.

(4) White, semibright plated coatings smooth and dense in texture result from the use of a neutral tin-lead alloy plating bath. Thanks to the neutrality, the bath according to the invention can be used without unfavorable effects in plating the parts of composite materials including glass and ceramics for light electric and electronic industries.

While the present invention is illustrated by the following several examples in which certain plating bath compositions and operating conditions are used, it is to be noted that the invention is not limited thereto but may be variously embodied with changes in the compositions and conditions to realize the afore-described objects of the invention.

EXAMPLE 1

A plating bath comprising

| | |
|---|---|
| divalent tin (as stannous 3-sulfopropionate) | 18 g/l |
| lead (as lead 3-sulfopropionate) | 2 g/l |
| sodium 3-sulfopropionate | 130 g/l |
| sodium acetate | 50 g/l |
| adduct (7 mol EO-5 mol PO) of polyoxyethylene laurylamine | 5 g/l |
| pH (adjusted with 3-sulfopropionic acid and NaOH) | 5.5 |

was used. An electric current at a density of 1 A/dm$^2$ was applied to a copper sheet placed in the bath at 25° C. for 5 minutes. A white, semibright plated coating with a smooth, dense surface resulted. The Pb content in the electrodeposit was 11.0%, and the current efficiency 100%. When an IC part incorporating lead glass was plated in the same way but at a current density of 2 A/dm$^2$, a satisfactory tin-lead alloy plated coating about 8 μm thick and white, semibright in appearance was formed without any attack on the lead glass.

EXAMPLE 2

A plating bath comprising

| | |
|---|---|
| divalent tin (as stannous 4-sulfophthalate) | 24 g/l |
| lead (as lead 4-sulfophthalate) | 16 g/l |
| sodium 4-sulfophthalate | 150 g/l |
| sodium acetate | 100 g/l |
| adduct (14 mol EO) of styrenated phenol | 10 g/l |
| pH (adjusted with 4-sulfophthalic acid and NaOH) | 4.0 |

was prepared. A current at a density of 3 A/dm$^2$ was applied to a copper piece placed in the bath at 20° C. for 10 minutes. A white, semibright plated coating with a smooth, dense texture was obtained. The Pb content in the electrodeposit was 42.8%, and the current density 95%. When an IC part using lead glass was plated at a current density of 2 A/dm$^2$, a good white, semibright plated coating about 10 μm thick was formed without damaging the lead glass.

EXAMPLE 3

A plating bath comprising

| | |
|---|---|
| divalent tin (as stannous 5-sulfosalicylate) | 9 g/l |
| lead (as lead 5-sulfosalicylate) | 1 g/l |
| potassium 5-sulfosalicylate | 200 g/l |
| ammonium borate | 50 g/l |
| adduct (7 mol EO-10 mol PO) of polyoxyethylene laurylamine | 20 g/l |
| N—(3-hydroxybutylidene)-p-sulfanilic acid | 2 g/l |
| pH (adjusted with 5-sulfosalicylic acid and KOH) | 7.2 |

was used. A current at a density of 0.5 A/dm$^2$ was flowed past a copper sheet in the bath at 20° C. for 20 minutes. A smooth, dense, white, semibright plated coating resulted. The Pb content in the electrodeposit was 12.5%, and the current efficiency 100%. An IC part incorporating lead glass was plated at a current density of 1 A/dm$^2$ to form a film about 5 μm thick. A satisfactory white, semibright tin-lead alloy plated coating was formed without any damage of the lead glass.

COMPARATIVE EXAMPLE 1

A plating bath comprising

| | |
|---|---|
| divalent tin (as stannous 5-sulfosalicylate) | 18 g/l |
| lead (as lead 5-sulfosalicylate) | 2 g/l |
| 5-sulfosalicylic acid | 150 g/l |
| adduct (7 mol EO-5 mol PO) of styrenated phenol | 5 g/l |
| pH (using no alkali, strongly acidic) | below 1.0 |

was employed. An IC part incorporating lead glass was plated at a current density of 2 A/dm$^2$ to form an about 10 μm-thick film. Since the bath was strongly acidic, the lead glass was seriously attacked, and an electrically quite poor plated coating resulted.

EXAMPLE 4

A plating bath comprising

| | |
|---|---|
| divalent tin (as stannous sulfosuccinate) | 27 g/l |
| lead (as lead sulfosuccinate) | 3 g/l |
| sodium sulfosuccinate | 160 g/l |
| sodium acetate | 75 g/l |
| adduct (7 mol EO-5 mol PO) of polyoxyethylene laurylamine | 15 g/l |

was used. Its pH value was varied over a range of 3.0–7.0 using sulfosuccinic acid and NaOH. The current density too was varied over a range of 0.5–3 A/dm$^2$. Using a copper wire (2 mm dia. by 200 mm length) as a cathode, plating was carried out by 600-coulomb constant current electrolysis, with cathode rocking at a rate of 2 m/min. The measured values of the lead contents (%) in the electrodeposits so formed and the current efficiencies (%) achieved are shown in TABLES 1 and 2.

TABLE 1

(with pH constant at 5.5)

| Bath | | Current density, DK (A/dm$^2$) 0.5 | 1.0 | 2.0 | 3.0 |
|---|---|---|---|---|---|
| EXAMPLE 4 | Pb % | 10.3 | 11.4 | 9.8 | 10.2 |
| | Cur. eff. % | 100 | 100 | 92.7 | 80.4 |

TABLE 2

(with Dk constant at 1.0 A/dm$^2$)

| Bath | | pH 3.0 | 4.0 | 5.0 | 7.0 |
|---|---|---|---|---|---|
| EXAMPLE 4 | Pb % | 11.5 | 10.3 | 9.6 | 9.9 |
| | Cur. eff. % | 99.3 | 98.2 | 99.2 | 100 |

TABLES 1 and 2 show that the baths of EXAMPLE 4 give electrodeposits similar in Pb% to the baths themselves despite changes in the pH or current density used. High current efficiencies achieved also indicate the possibility of effective bath control.

EXAMPLE 5

A plating bath comprising

| | |
|---|---|
| divalent tin (as stannous 3-sulfobenzoate) | 54 g/l |
| lead (as lead 3-sulfobenzoate) | 6 g/l |
| sodium 3-sulfobenzoate | 200 g/l |
| sodium tartarate | 120 g/l |
| adduct (14 mol EO) of styrenated phenol | 5 g/l |
| pH (adjusted with 3-sulfobenzoic acid and NaOH) | 7.5 |

was used. A copper wire was plated in the bath at 30° C., applying a current at a density of 20 A/dm$^2$ for 10 minutes. A smooth, dense, white, semibright plated coating was obtained. The Pb% in the electrodeposit was 10.5%, and the current efficiency 75%.

EXAMPLE 6

A plating bath comprising

| | |
|---|---|
| divalent tin (as stannous sulfosuccinate) | 4 g/l |
| lead (as lead sulfosuccinate) | 16 g/l |
| potassium sulfosuccinate | 100 g/l |
| sodium formate | 65 g/l |
| "Adekatol PC-10" | 5 g/l |
| pH (adjusted with sulfosuccinic acid and KOH) | 6.5 |

was used. A current at a density of 1.5 A/dm$^2$ was applied to a copper sheet placed in the bath at 25° C. for 30 minutes. A smooth, semibright plated coating resulted. The Pb content in the electrodeposit was 81.0%, and the current efficiency 98.5%.

EXAMPLE 7

A plating bath comprising

| | |
|---|---|
| divalent tin (as stannous methanesulfonate) | 20 g/l |
| potassium sulfosuccinate | 150 g/l |
| potassium acetate | 50 g/l |
| adduct (7 mol EO-5 mol PO) of styrenated phenol | 10 g/l |
| pH (adjusted with methanesulfonic acid and KOH) | 6.5 |

was used. A current at a density of 2 A/dm$^2$ was applied to a copper sheet at 25° C. for 10 minutes, and a white, semibright plated coating smooth and dense in texture was obtained. The current efficiency was 70%.

EXAMPLE 8

A plating bath comprising

| | |
|---|---|
| lead (as lead acetate) | 10 g/l |
| sodium 3-sulfopropionate | 100 g/l |
| sodium acetate | 50 g/l |
| adduct (1 mol EO-S mol PO) of oxyethylene laurylamine | 2 g/l |
| pH (adjusted with 3-sulfopropionic acid and NaOH) | 5.0 |

was prepared. A copper sheet was plated in the bath, using a current density of 1 A/dm$^2$ at 30° C. for 20 minutes. A smooth, grayish semibright plated coating was obtained. The current efficiency was 90%.

EXAMPLE 9

A plating bath comprising

| | |
|---|---|
| divalent tin (as stannous 1-hydroxypropanesulfonate) | 9 g/l |
| lead (as lead carbonate) | 1 g/l |
| potassium 4-sulfophthalate | 120 g/l |
| potassium borate | 30 g/l |
| adduct (1 mol EO-3 mol PO) of polyoxyethylene laurylamine | 5 g/l |
| pH (adjusted with 4-sulfophthalic acid and KOH) | 7.0 |

was used. A current at a density of 1.5 A/dm$^2$ was flowed past a copper sheet in the bath at 25° C. for 10 minutes. A white, semibright plated coating smooth and dense in texture resulted. The Pb% in the electrodeposit was 9.8%, and the current efficiency 92%.

What is claimed is:

1. A tin, lead, or tin-lead alloy plating bath comprising, as essential ingredients, 0.01 to 10 moles per liter of the plating bath of an alkali metal salt of an aliphatic or aromatic sulfocarboxylic acid of the general formula

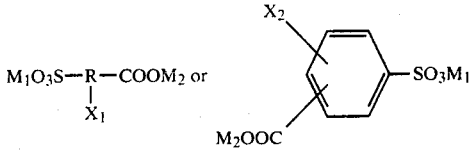

wherein R is a $C_{1-4}$ hydrocarbon radical, $M_1$ is a hydrogen atom or alkali metal atom, $M_2$ is an alkali metal atom, and $X_1$ and $X_2$ are each a hydrogen atom, OH, COOZ, or $SO_3Z$, Z being a hydrogen atom or alkali metal atom; and a soluble divalent tin compound and/or a soluble divalent lead compound; said bath having a pH of from 3–8.5.

2. A plating bath according to claim 1 in which the soluble divalent tin compound or/and the lead compound are a divalent tin salt or/and a lead salt of an aliphatic or aromatic sulfocarboxylic acid of the general formula

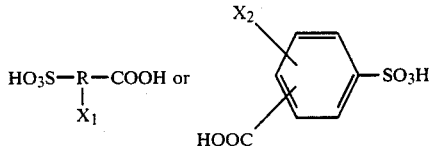

wherein R is a $C_{1-4}$ hydrocarbon radical and $X_1$ and $X_2$ are each a hydrogen atom, OH, COOH, or $SO_3H$.

3. A plating bath according to claim 1 in which the soluble divalent tin compound or/and the lead compound are a divalent tin salt or/and a lead salt of an alkane- or alkanolsulfonic acid of the general formula $R_1—SO_3H$ or $HO—R_2—SO_3H$ wherein $R_1$ is a $C_{1-12}$ alkyl radical and $R_2$ is a $C_{1-12}$ alkylene radical, OH being located in any desired position of the alkylene radical.

4. A plating bath according to claim 1 wherein the soluble divalent tin compound or/and the lead compound are a divalent tin salt or/and a lead salt of an organic carboxylic acid.

5. A plating bath according to claim 1 wherein the soluble divalent tin compound or/and the lead compound are a divalent tin salt or/and a lead salt of an inorganic acid.

6. A plating bath according to claim 1 wherein the soluble divalent tin compound or/and the lead compound are stannous oxide or/and lead oxide.

7. A plating bath according to any of claims 1 through 6 wherein the soluble divalent tin compound or/and the lead compound are present, in terms of the metallic element or elements, at a concentration of 0.5 to 200 g per liter of the plating solution.

8. A plating bath according to claim 7 wherein a nonionic surface active agent and/or a leveling agent is present in the bath.

9. A plating bath according to claim 7 wherein a pH buffering agent is present in the bath.

10. A tin-lead alloy plating bath comprising, as essential ingredients, 0.01 to 10 moles per liter of the plating bath of an alkali metal salt of an aliphatic or aromatic sulfocarboxylic acid of the general formula

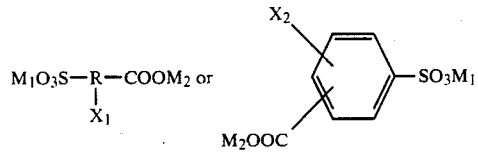

wherein R is a $C_{1-4}$ hydrocarbon radical, $M_1$ is a hydrogen atom or alkali metal atom, $M_2$ is an alkali metal atom, and $X_1$ and $X_2$ are each a hydrogen atom, OH, COOZ, or $SO_3Z$, Z being a hydrogen atom or alkali metal atom; a soluble divalent tin compound and a soluble divalent lead compound; and a guanamine compound having the general formula

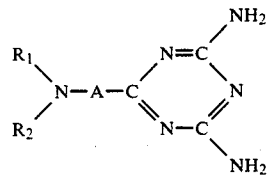

wherein $R_1$ and $R_2$, which may be the same or different, each represent a hydrogen atom, $C_{1-18}$ straight- or branched-chain alkyl radical, $C_{1-18}$ straight- or branched-chain alkoxy-lower alkyl radical, or a $C_{3-7}$ cycloalkyl radical, or $R_1$ and $R_2$ may combine with the nitrogen atom to form a piperidine, morpholine or piperazine cycle, and A represents a lower alkylene radical; said bath having a pH of from 3 to 8.5.

* * * * *